US008601852B2

(12) United States Patent
Osako

(10) Patent No.: US 8,601,852 B2
(45) Date of Patent: Dec. 10, 2013

(54) METHOD OF MANUFACTURING SEAMLESS PIPE AND TUBE

(75) Inventor: Hajime Osako, Wakayama (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 585 days.

(21) Appl. No.: 12/232,926

(22) Filed: Sep. 26, 2008

(65) Prior Publication Data

US 2009/0038358 A1 Feb. 12, 2009

(30) Foreign Application Priority Data

Mar. 28, 2006 (JP) ..... 2006-088462

(51) Int. Cl.

| | |
|---|---|
| ***B21C 37/06*** | (2006.01) |
| ***B21D 31/00*** | (2006.01) |
| ***B21B 19/04*** | (2006.01) |

(52) U.S. Cl.
USPC ..... 72/368; 72/364; 72/97

(58) Field of Classification Search
USPC ..... 72/97, 200, 367.1, 368, 342.1, 364
See application file for complete search history.

(56) References Cited

U.S. PATENT DOCUMENTS

| | | | | |
|---|---|---|---|---|
| 4,075,041 | A | 2/1978 | Ueno et al. | |
| 4,991,419 | A * | 2/1991 | Kuroda et al. | 72/97 |
| 6,024,808 | A * | 2/2000 | Kondo et al. | 148/541 |
| 2001/0027831 | A1 | 10/2001 | Toyooka et al. | |

FOREIGN PATENT DOCUMENTS

| | | | |
|---|---|---|---|
| AR | 230652 | | 5/1984 |
| AR | 001416 | | 10/1997 |
| AR | 001655 | | 11/1997 |
| AR | 035035 | | 4/2004 |
| GB | 2137539 | | 10/1984 |
| JP | 59-150019 | | 8/1984 |
| JP | 59-182919 | | 10/1984 |
| JP | 01-168814 | | 7/1989 |
| JP | 03146206 | A * | 6/1991 |
| JP | 5-098350 | | 4/1993 |
| JP | 08-311551 | | 11/1996 |
| JP | 09-287028 | | 11/1997 |
| JP | 2001-240913 | | 9/2001 |
| JP | 2003-225705 | | 8/2003 |
| RU | 2 086 670 | | 8/1997 |
| RU | 2 210 604 | | 8/2003 |
| SU | 1183552 | | 12/1983 |
| WO | WO96/12574 | | 5/1996 |
| WO | 98/01589 | | 1/1998 |

OTHER PUBLICATIONS

Kondo/Exhibit A: "Basic-Abstract" retrieved from Derwent database, 1991, pp. 1-3.*

* cited by examiner

*Primary Examiner* — Teresa M Ekiert
(74) *Attorney, Agent, or Firm* — Clark & Brody

(57) ABSTRACT

It is a problem of the present invention to provide a method of manufacturing the seamless pipes having better mechanical properties, by means of a pipe manufacturing method with large energy-saving effect to continuously carry out processes from pierce-rolling to heat treatment.

A method of manufacturing a seamless pipe comprising the steps of a pierce-rolling process, elongation rolling process, sizing process, reheating process, quenching process and tempering process, wherein the sizing process is completed with a temperature of the seamless pipe not less than 600° C. but less than 800° C., the seamless pipe is charged into a reheating furnace with a temperature not less than 400° C. and is reheated with a temperature not less than $Ac_3$ transformation temperature but not greater than 1000° C. in the reheating process.

2 Claims, 1 Drawing Sheet

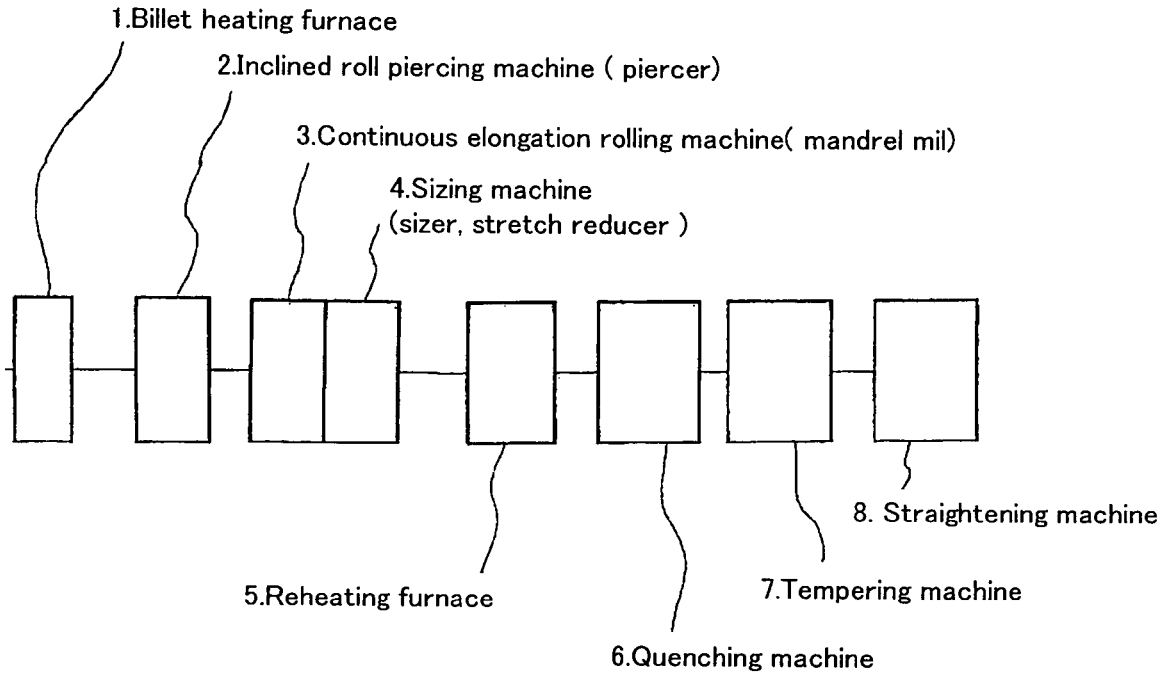
1.Billet heating furnace
2.Inclined roll piercing machine ( piercer)
3.Continuous elongation rolling machine( mandrel mil)
4.Sizing machine
(sizer, stretch reducer )
8. Straightening machine
5.Reheating furnace
7.Tempering machine
6.Quenching machine

METHOD OF MANUFACTURING SEAMLESS PIPE AND TUBE

This application is a continuation of International Patent Application No. PCT/JP2007/055074 filed Mar. 14, 2007. This PCT application was not in English as published under PCT Article 21(2).

The disclosure of Japan Patent Application No. 2006-088462 filed Mar. 28, 2006 including specification, drawings and claims is incorporated herein by reference in its entirety.

TECHNICAL FIELD

The present invention relates to a manufacturing technique of seamless pipes and tube (hereinafter described as "pipes") and, more particularly, to a method of manufacturing high-strength and high-toughness seamless pipes.

BACKGROUND ART

Steel industries, having large facilities and large amounts of energy consumption, are under necessity of a continuous process, for the purpose of process-saving and energy-saving. In a field of seamless pipes, for example, a technology that heat treatment, such as "quenching" and "tempering", which was so far provided by a facility of another line is continuously carried out after rolling process, is under consideration.

It is necessary to carefully select process conditions in order to materialize the continuous process, since the seamless pipes have extremely severe demands for reliability of the products. The following present applicants disclose some process conditions in terms of energy-saving.

[Patent document 1] Republished patent application WO 1996/12574-B

[Patent document 2] Japanese Unexamined Patent Publication No. 1996-311551-A

[Patent document 3] Japanese Unexamined Patent Publication No. 2001-240913-A

In recent years, excellent performance has been required for the seamless pipes. At a relatively high rolling finishing temperature as described in the above-mentioned documents, however, it becomes apparent that crystal grain is still coarse even when subsequent concurrent heating and heat treatment is conducted and that it is difficult to cope with higher demands especially concerning toughness of the products.

DISCLOSURE OF THE INVENTION

Problems to be solved by the Invention

An object of the present invention is to provide a method of manufacturing seamless pipes with continuous process from pierce-rolling process to heat treatment.

Means for solving the Problems

As the above mentioned, the present inventors examined the conventional techniques as described in the patent documents 1 to 3 in detail and found that the grain size in products, manufactured in the continuous process, could not be refined sufficiently.

The present invention is completed by optimally selecting each condition from pierce-rolling process to heat treatment on the basis of the above-mentioned findings. The subject matter of the present invention is a method of manufacturing seamless pipes described below.

A method of manufacturing a seamless pipe and tube comprising the steps of a pierce rolling process, elongation rolling process, sizing process, reheating process, quenching process and tempering process, wherein the sizing process is completed with a temperature of the seamless pipe not less than 600° C. but less than 800° C., the seamless pipe is charged into a reheating furnace with a temperature not less than 400° C. and is reheated with a temperature not less than $Ac_3$ transformation temperature but not greater than 1000° C. in the reheating process.

Effect of the invention

According to the present invention, high-strength and high-toughness seamless pipes can be manufactured in the continuous process from pierce rolling process to heat treatment.

BEST MODE FOR CARRYING OUT THE INVENTION

FIG. 1 is a view showing a line configuration for carrying out the method according to the present invention. As shown in FIG. 1, apparatuses from a billet heating furnace 1 to a straightening machine 8 are laid out in a single continuous line. While referring to FIG. 1, each process of the present invention is described.

(1) Pierce-rolling process, elongation rolling process, and sizing process

A billet is heated in the heating furnace 1 and pierced by a piercing mill, for example, an inclined roll piercing machine (piercer) 2 to become a hollow shell. As a pierce-rolling process, other various pierce-rolling processes including Mannesmann type pierce-rolling method can be applied. The pierce-rolling requirements are not subject to any constraints. A billet may be manufactured from an ingot by a stabbing mill or, for example, a so-called round billet, which is continuously cast using a casting mold of circular section, may be used.

The pierced hollow shell is rolled using a continuous elongation rolling machine 3 and a sizing machine 4. The continuous elongation rolling machine includes a mandrel mill, and the sizing machine 4 includes a sizer, and a stretch reducer.

(2) Temperature of the seamless pipe when the sizing process is completed

The temperature must be in a range of not less than 600° C. but less than 800° C. Because, under the condition that the temperature of the seamless pipe is lower than 600° C. when the sizing process is completed, an excessive load is applied to the sizing facility, resulting in the difficulty of sizing process.

On the one hand, when the temperature of the seamless pipe is not 800° C. or greater, there is insufficient structural refinement of crystal grains of the products even if the seamless pipes are carried out reheating described below and "direct quenching-tempering". If the temperature of the seamless pipe can be adjusted so as to be in a range not less than 600° C. but less than 800° C. when the sizing process is completed, the growth of the grains of the product structure is inhibited and extremely fine crystal grain structure is obtained. Accordingly, as hereinafter described in the embodiments, it is possible to obtain the products with excellent properties such as toughness.

(3) Cooling and reheating after the sizing process

After the sizing process is completed, the seamless pipes are reheated in a reheating furnace 5. Although the temperature of the seamless pipes is lowered from completing the sizing process to shifting to the reheating process, the temperature shall be in a range not less than 400° C. but less than 800° C. In other words, the seamless pipes must be charged into the reheating furnace while the temperature of the seamless pipes is in a range not less than 400° C. but less than 800° C.

When the temperature of the seamless pipe is lowered below 400° C. after the sizing process, martensite transformation is yielded in the product structure and then reversely transformed into austenite during successive reheating. Therefore, the seamless pipes are bent and deformed. Besides, since the seamless pipes must be stayed longer in the reheating furnace, not only productivity is lowered, but also the amount of energy required for reheating is increased.

With the assumption that the reheating furnace is disposed in a single line, since it is possible to prevent the temperature of the seamless pipe from being dropped as little as possible after completing the sizing process to shifting to reheating, the requirements of the above-mentioned reheating furnace charging temperature can easily be realized. Besides, the temperature of the seamless pipe may be prevented from being dropped by providing a transportation facility, which connects the sizing process and the reheating, with a thermal insulation cover.

The reheating temperature shall be not less than $Ac_3$ transformation point and not more than 1000° C. Preferably, it shall be in a range of 850 to 1000° C. The temperature of not less than $Ac_3$ transformation point is required to transform the product structure to austenite before proceeding to the following quenching process. Besides, the reason why 1000° C. is set as an upper limit is described as follows: because the crystal grain in the product structure becomes coarse when the product is heated at greater than 1000° C., and this causes product toughness to be lowered after the quenching process. Moreover, since ferrite is separated out in the product structure prior to water cooling treatment when the initiation temperature of the quenching process is less than $Ac_3$ transformation point, sufficient quench hardening is not obtained, and this causes strength and toughness of the product to be deteriorated. The reason why 850° C. is preferable as a lower limit of reheating temperature is to prevent the above-mentioned harmful effects.

The heating time may be enough to form austenite structure all over the product according to product thickness and so forth.

(4) Quenching process and tempering process

The seamless pipes taken out of the reheating furnace are brought to be not less than $Ac_3$ transformation point by means of reheating. Accordingly, the seamless pipes are immediately introduced into a quenching machine 6, for example, "water-cooling apparatus", before quenching. Besides, it is preferable to use a quenching apparatus capable of simultaneously cooling both inside and outside of the seamless pipes, in order to evenly quench thick seamless pipes.

The seamless pipes are tempered by a tempering machine 7 after quenching. The tempering condition may be decided depending on the material and the required quality of the seamless pipe. The seamless pipes are straightened by the straightening machine 8 after the above-mentioned heat treatment. Besides, this straightening treatment may be performed offline.

(5) Chemical composition of seamless pipe

There is not any constraint on chemical composition of seamless pipe manufactured according to the present invention. In general, every type of steel used for oil well tubular and line pipe can be employed.

Embodiments

A billet of the composition consisting of C: 0.27%, S: 0.2%, Mn: 0.6%, Cr: 0.6%, Mo: 0.05%, V: 0.05%, and the balance being Fe and impurities was used to manufacture the seamless pipes of 177.8 mm in O.D. and 10.36 mm in thickness in a manufacturing line as shown in FIG. 1. The heating temperature of the billet, the temperature of the seamless pipe when the sizing was completed, the temperature of the seamless pipe when the seamless pipe was charged into the reheating furnace, the reheating temperature and tempering temperature were changed as shown in Table 1. Besides, the seamless pipe picked out from the reheating furnace was immediately quenched by water-cooling. Crystal grain size number (according to JIS G 0551) and mechanical property of the manufactured seamless pipe is shown in Table 1.

TABLE 1

| division | No. | The Heating Temp. (° C.) of the Billet | The Temp. (° C.) of the seamless pipe when a sizing was completed | The Temp. (° C.) of the seamless pipe when the seamless pipe was charged into reheating furnace | The Reheating Temp. (° C.) | The Tempering Temp. (° C.) | Crystal Grain size Number* | strength YS (ksi) | strength TS (ksi) | The Transition Temp. of the Charpy Impact Test |
|---|---|---|---|---|---|---|---|---|---|---|
| Present Invention | 1 | 1250 | 790 | 695 | 950 | 700 | 7.5 | 96.3 | 113.0 | −80 |
| | 2 | 1250 | 702 | 601 | 950 | 700 | 7.8 | 95.5 | 111.8 | −82 |
| | 3 | 1250 | 750 | 505 | 950 | 700 | 8.0 | 96.3 | 112.5 | −95 |
| Comparative Example | 4 | 1250 | 951 | 848 | 950 | 700 | 5.5 | 96.2 | 116.1 | −46 |
| | 5 | 1250 | 1033 | 911 | 950 | 700 | 5.6 | 97.0 | 117.1 | −42 |

*Crystal Grain size Number defined by JIS G 0551

As shown in Table 1, Nos. 1 to 3 were the conditions of sizing process and subsequent heating treatments which meet the present invention. These crystal grain size numbers are in a range of 7.5 to 8.0, i.e. the crystals are structurally refined. Therefore, the seamless pipes are superior in toughness as well as high strength.

In the comparative examples, in which the temperature of the seamless pipe is excessively high when the sizing process is completed and when the seamless pipes are charged into the reheating furnace, shows that the transition temperature of the Charpy impact test is significantly high because of coarse crystal size. That is to say, the physical property is inferior in toughness.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

INDUSTRIAL APPLICABILITY

According to the method of the present invention, a seamless pipe consisting of fine crystal grain and having significantly superior mechanical property can be manufactured. Moreover, according to the method of the present invention, energy consumption can be reduced and manufacturing cost can greatly be curtailed, since all processes from billet heating to heat treatment are continuously performed in a single manufacturing line. The seamless pipes manufactured according to the method of the present invention are preferably used for oil well tubular and so forth requiring superior low-temperature toughness.

BRIEF DESCRIPTION OF THE DRAWINGS

FIG. 1 is a view showing an example of a row of facilities according to the method of the present invention.

| Description of the Reference Numerals | |
|---|---|
| 1. | Billet heating furnace |
| 2. | Inclined roll piercing machine (piercer) |
| 3. | Continuous elongation rolling machine |
| 4. | Sizing machine |
| 5. | Reheating furnace |
| 6. | Quenching machine |
| 7. | Tempering machine |
| 8. | Straightening machine |

The invention claimed is:

1. A method of manufacturing a seamless steel pipe or tube comprising the steps of a pierce-rolling process, elongation rolling process, sizing process, reheating process, quenching process and tempering process, wherein the sizing process is completed with a temperature of the seamless steel pipe or tube not less than 600° C. but less than 790° C., the seamless steel pipe or tube is charged into a reheating furnace with a temperature not less than 400° C. and is reheated with a temperature not less than $Ac_3$ transformation temperature but not greater than 1000° C. in the reheating process.

2. The method of claim 1, wherein the sizing process is completed with a temperature of the seamless steel pipe or tube not less than 702° C. but less than 790° C.

* * * * *